US005327803A

United States Patent [19]

deMey, III

[11] Patent Number: 5,327,803

[45] Date of Patent: Jul. 12, 1994

[54] TRANSFER APPARATUS FOR CIGARETTES AND OTHER ROD-SHAPED ARTICLES

[75] Inventor: C. Fred deMey, III, Belews Creek, N.C.

[73] Assignee: R. J. Reynolds Tobacco Company, Winston-Salem, N.C.

[21] Appl. No.: 962,762

[22] Filed: Oct. 19, 1992

[51] Int. Cl.[5] ..... B26D 7/06

[52] U.S. Cl. ..... 83/152; 83/154; 198/427; 198/428; 198/438; 198/441; 198/471.1; 198/475.1

[58] Field of Search ..... 198/427, 428, 438, 441, 198/471.1, 474.1–476.1, 797; 131/282; 83/152, 154, 158, 161

[56] References Cited

U.S. PATENT DOCUMENTS

| | | | |
|---|---|---|---|
| 2,861,672 | 11/1958 | Buhrer et al. | 198/475.1 |
| 3,218,069 | 11/1965 | Halberschmidt | 199/438 |
| 3,303,926 | 2/1967 | Pohl . | |
| 3,343,691 | 9/1967 | Anderson | 198/797 |
| 3,521,513 | 7/1970 | Gomann et al. | 198/471.1 |
| 3,567,011 | 3/1971 | Pinkham . | |
| 3,583,546 | 6/1971 | Koop . | |
| 3,847,267 | 11/1974 | Patten | 198/797 |
| 4,051,947 | 10/1977 | Schumacher et al. . | |
| 4,406,197 | 9/1983 | Bardenhagen et al. . | |
| 4,408,621 | 10/1983 | Schumacher . | |
| 4,465,083 | 8/1984 | Schumacher . | |
| 4,558,778 | 12/1985 | Cristiani . | |
| 4,574,818 | 3/1986 | Pagnoni | 198/475.1 |
| 4,645,063 | 2/1987 | Seragnoli . | |
| 4,804,079 | 2/1989 | Hensgen et al. . | |
| 4,827,948 | 5/1989 | Schumacher . | |
| 5,007,784 | 4/1991 | Genov et al. | 198/476.1 |

*Primary Examiner*—Joseph E. Valenza

[57] ABSTRACT

A transfer apparatus for rod-shaped articles, such as cigarettes, comprising a housing rotatably mounted to a fixed main shaft with a plurality of cooperating crank arms and article holders rotatably mounted to the housing by crank arm shafts and holder shafts. The crank arms and article holders are rotated in response to rotation of the housing by means of a plurality of endless toothed belts cooperating between toothed pulleys on the main shaft and the crank arm shafts and a plurality of endless toothed belts cooperating between toothed pulleys on the main shaft and on the holder shafts.

21 Claims, 5 Drawing Sheets

TRANSFER APPARATUS FOR CIGARETTES AND OTHER ROD-SHAPED ARTICLES

FIELD OF THE INVENTION

The present invention relates to transfer apparatus for rod-shaped articles such as cigarettes and more particularly, to an improvement in apparatus which can convert a file of rod-shaped articles aligned end-to-end into a file of parallel rows, or vice versa. The improvement relates to the replacement of a gear drive with a belt drive mechanism and hence the elimination of the required lubrication for the gear drive and the seals for the lubricant.

BACKGROUND OF THE INVENTION

In the production of rod-shaped articles such as cigarettes, the articles come from a rod maker either as individual articles or as a continuous rod which is cut or otherwise separated into individual articles of a desired length. Such rod-shaped articles are aligned initially in a serial, end-to-end file. However, for the purpose of further processing and/or packaging, it is desirable to align the rod-shaped articles in a file of parallel rows.

This function has typically been performed by an apparatus which includes a conveyor for conveying a rod-shaped product or rod-shaped articles, a knife or other device for cutting the product into discrete rod-shaped articles if the product is not already separated into discrete rod-shaped articles at the maker, a rotary "spider mechanism" having a plurality of crank arms attached thereto, each crank arm having a holder for picking up an individual rod-shaped article from the serial end-to-end file and for moving the article to a position to be released to a rotary drum which forms the articles into a file of parallel rows. Such a transfer apparatus is well-known and conventional in the cigarette making art and is manufactured by, among others, Hauni-Werke Körber & Co. KG of Hamburg, Germany. Exemplary of such conventional transfer apparatus are the apparatus shown in U.S. Pat. Nos. 4,051,947; 4,408,621; and 4,465,083.

The spider mechanism is a complex device in that, in order to transfer rod-shaped articles from a moving end-to-end or serial file to a file of parallel rows, the pickup devices or article holders move parallel to and at essentially the same speed as the serial file to remove each individual article from the file in succession. Each holder is then rotated to a position where the lateral holder speed is essentially zero so that the article can be transferred to a rotary drum to convert the serial file along one axis to a file of parallel rows each parallel to the serial file axis. The holders are typically maintained essentially parallel to the serial file axis throughout their travel and follow an orbital or elliptical path in response to the combined rotation of the spider mechanism housing housing and the crank arms relative to the spider mechanism. The spider mechanism can also be operated in the reverse direction to convert a file of parallel rows to an end-to-end or serial file.

One typical spider mechanism is disclosed in the aforementioned U.S. Pat. No. 4,051,947 to Schumacher et al., the disclosure of which is hereby incorporated by reference. That patent illustrates a spider mechanism in which a plurality of holders and crank arms are rotatably mounted to a rotatable housing for counterrotation relative to the housing. In order to coordinate the relative motion of the housing, holders and crank arms, a planetary gear assembly is required. Because gearing is used, the gears must be lubricated and seals must be provided at the rotational interfaces between the holders and the crank arms and between the crank arms and the rotatable housing. The seals are prone to wear and ultimately to failure or leakage. Since there may be six to eight or more crank arm and holder combinations with as many as four seals for each combination, the number of individual seals subject to leakage can multiply rapidly. The consequence of such failure or leakage is that lubricant contaminates the rod-shaped articles being processed by the transfer device. This results in either costly sorting to eliminate the contaminated articles from the uncontaminated articles or, in the case of cigarette articles, disposal of the entire batch. In addition, the replacement of seals in the spider mechanism involves a time consuming disassembly and reassembly process.

SUMMARY OF THE INVENTION

The present invention is directed to overcoming the deficiencies in the prior art by providing a rod-shaped article transfer device including a spider assembly which eliminates the need for lubrication of the drive mechanism. Rather than employ a conventional planetary gear arrangement to coordinate and drive the crank arms and article holders of the spider assembly, the present invention is directed to a spider assembly in which a plurality of pulleys and endless belts apply drive force from a main shaft to each crank arm and article holder.

In a first drive arrangement, the crank arms are driven in adjacent pairs by a series of crank arm drive pulleys coaxially mounted on a main shaft, with each drive pulley having an associated belt tensioning pulley and a toothed endless drive belt trained about the drive pulley and a pair of crank arm shaft pulleys, each mounted on an adjacent crank arm shaft. Two sets of four article holders each are driven by a drive arrangement in which a holder drive pulley mounted on the main shaft is drivingly connected to each set of four holder shaft pulleys and holder shafts by three toothed endless belts. Two holder shafts of each set of four have a pair of coaxial holder shaft pulleys mounted thereon, one of each coaxial pair being driven by a first belt drivingly connected to one holder drive pulley. The other of each pair of coaxial holder shaft pulleys is drivingly connected by a respective second and third belt to a holder drive pulley on an adjacent holder shaft. Belt tensioning pulleys are provided for each of the three belts of each set of four article holders.

In an alternative arrangement for the drive of the crank arms, a first drive belt is trained about a crank arm drive pulley on the main shaft and one of a pair of coaxially- mounted crank arm shaft pulleys. A second belt is trained about an adjacent crank arm shaft pulley and the other crank arm shaft pulley of the coaxially-mounted pair. Each belt is tensioned by a tensioning pulley associated therewith.

The belts and pulleys are preferably toothed so as to have intermeshing teeth. The initial alignment, cooperation and relative speeds of rotation of the spider mechanism housing, crank arms and holders are selected, as well as known and understood by those skilled in the art, to assure that the crank arms and holders counterrotate independently of the housing, with two revolutions of the crank arms for each revolution of the housing and one revolution of the holders for each revolution of the housing. By proper selection of pulley diameters and initial alignment, the holders are maintained in the desired position relative to the rod-shaped articles to be rearranged.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
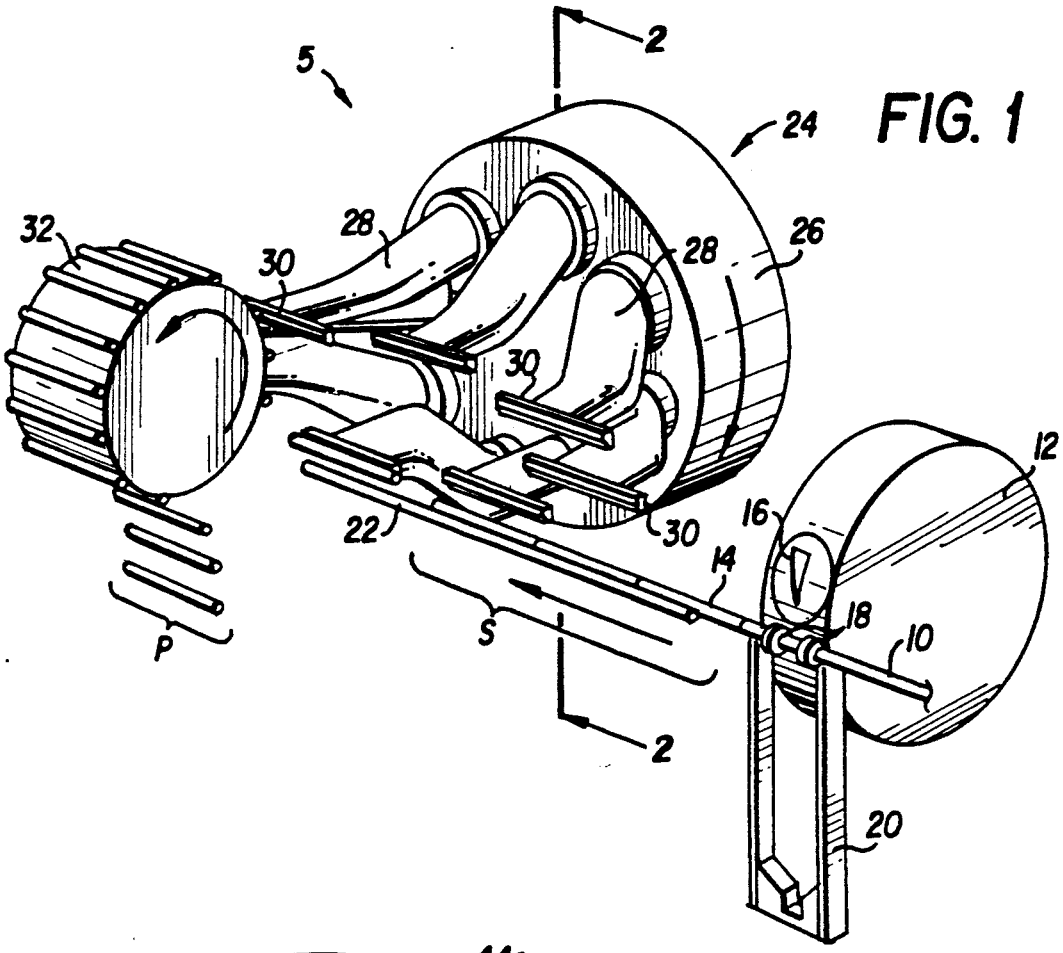
FIG. 1 is a perspective view showing a transfer device in operation converting a serial file of rod-shaped articles to a parallel row of articles.

Referring now in detail to the drawings, wherein like parts are designated by like reference numerals throughout, there is illustrated in FIG. 1 an apparatus 5 for arranging a serial end-to-end file S of cigarettes coming from a conventional cigarette making machine (not shown) into a file of parallel rows P of cigarettes. A continuous cigarette rod 10 coming from the cigarette maker is fed past a rotary cutter 12 where it is cut into individual rod-shaped articles or cigarettes 14 by a blade 16 attached to rotary cutter 12. When the cigarette rod 10 is cut, it is held by rings 18 mounted on support 20. The individual cigarettes 14 are transported along a guide 22 past a spider mechanism 24. Spider mechanism 24 is comprised of a rotary housing 26 to which a plurality of crank arms 28 (eight in the described embodiment) are rotatably mounted. Each crank arm has an article holder 30 mounted for rotary movement at the end thereof. A rotatable drum-shaped conveyor 32 is positioned adjacent the path of travel of the crank arms 28 for a purpose to be described.

As is well known and understood in the art, when the housing 26 is rotated clockwise as shown by the arrow in FIG. 1, the crank arms 28 rotate counterclockwise relative to the housing 26 and each article holder 30 rotates clockwise relative to the crank arm 28 associated therewith in such a manner that the longitudinal axes of the article holders 30 remain parallel to the axis of travel of the serial file S of cigarettes 14 and the outer ends of the crank arms travel in an orbital or elliptical path about the rotational axis of the housing 26. As is also well known, such orbital or elliptical path of movement results in a maximum holder velocity along the axis of serial file S when the holders 30 are at the uppermost and lowermost points on the orbital path and a minimum (zero) holder velocity along the axis of serial file S when the holders 30 are at the extreme right and left lateral points on the orbital path with reference to FIG. 1.

Thus, as the individual cigarettes 14 in file S move serially to a transfer position at the downstream end of the guide 22 at a given velocity, each holder 30 in turn moves into a position on the lowermost point of the orbital path at which it is closely adjacent the cigarette transfer position and is moving substantially at the same velocity as the cigarette file S. Suction is then applied to the holder 30 located at that position to extract the cigarette located at the transfer position on the guide 22 and carry it along the orbital path. When each holder 30 carrying a cigarette 14 reaches the leftmost position on the orbital path where the holder velocity parallel to the axis of file S is minimum or zero, the individual cigarettes carried by the holders are transferred by suction to the periphery of the drum conveyor 32 thereby converting the serial, end-to-end file S to the file of parallel rows P.

In the prior art apparatus, as evidenced, for example, by the aforementioned U.S. Pat. No. 4,051,947, the above-described orbital movement of the crank arms 28 and holders 30 is accomplished by a planetary gear transmission made up of a plurality of meshing gear trains. According to the present invention, the orbital movement of the crank arms and holders is accomplished by a toothed belt and pulley arrangement as shown and described in connection with FIGS. 2–8.

Figure 2:
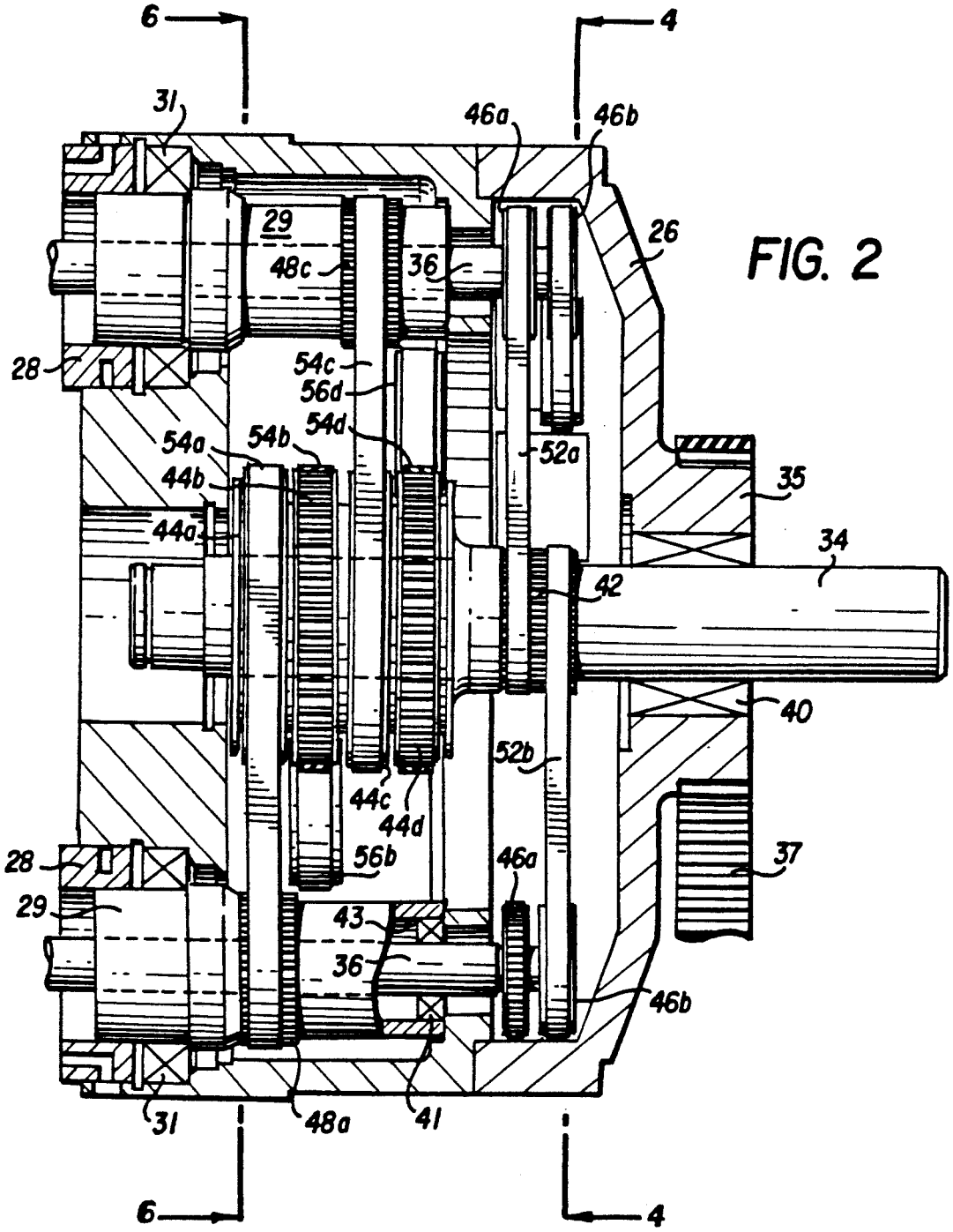
FIG. 2 is a cross-sectional view, taken along line 2—2 of FIG. 1, of a spider assembly housing showing the belt and pulley drive arrangement for the transfer apparatus.

Referring first to FIG. 2, rotary housing 26 is rotatably mounted to a fixed main shaft 34 by means of an anti-friction bearing 40. A toothed pulley 35 integrally formed with housing 26, or separately formed and secured to housing 26, is driven by a toothed belt 37 to rotate housing 26 about the axis of shaft 34. Main shaft 34 is supported at its right hand end as viewed in FIG. 2 in a cantilevered manner by conventional means (not shown). A plurality of toothed crank arm drive pulleys **44*a*–44*d* and a toothed article holder drive pulley 42 are fixedly mounted to or formed on main shaft 34. The eight crank arms 28 (only partially shown in FIG. 2) are each mounted on the end of a respective crank arm shaft 29 which is rotatably supported in housing 26 by an anti-friction bearing 31. Each crank arm shaft 29 is provided with a respective toothed crank arm shaft pulley 48*a*–48*d* substantially coplanar aligned with a respective crank arm drive pulley 44*a*–44*d***.

An article holder shaft 36 is rotatably supported by a pair of spaced anti-friction bearings 41 (only one shown in FIG. 2) coaxially within the central bore 43 of each of the eight crank arm shafts 29. Four of the eight article holder shafts 36 are provided on the right hand ends thereof with a coaxial pair of toothed holder shaft pulleys **46*a*–46*b* and the remaining four shafts 36 are provided with a single toothed holder shaft pulley 46 as more fully described hereinafter in connection with FIGS. 4 and 5. Toothed endless belts 52*a*–52*b* are drivingly trained about article holder drive pulley 42 and a respective holder shaft pulley 46*a*–46*b* and toothed endless belts 54*a*–54*d* are drivingly trained about a respective crank arm drive pulley 44*a*–44*d* and a respective crank arm shaft pulley 48***a*–48*d*. Four toothed belt tensioner pulleys 56*a*–56*d* (only two shown in FIG. 2) are rotatably mounted on tensioner arms for adjusting the tension of a respective toothed belt 54*a*–54*d*. Toothed belt tensioner pulleys are also provided for adjusting the tension in the toothed belts 52*a*, 52*b* used to drive the holder shaft pulleys 46*a*, 46*b* and 46. See FIG. 4.

Figure 3:
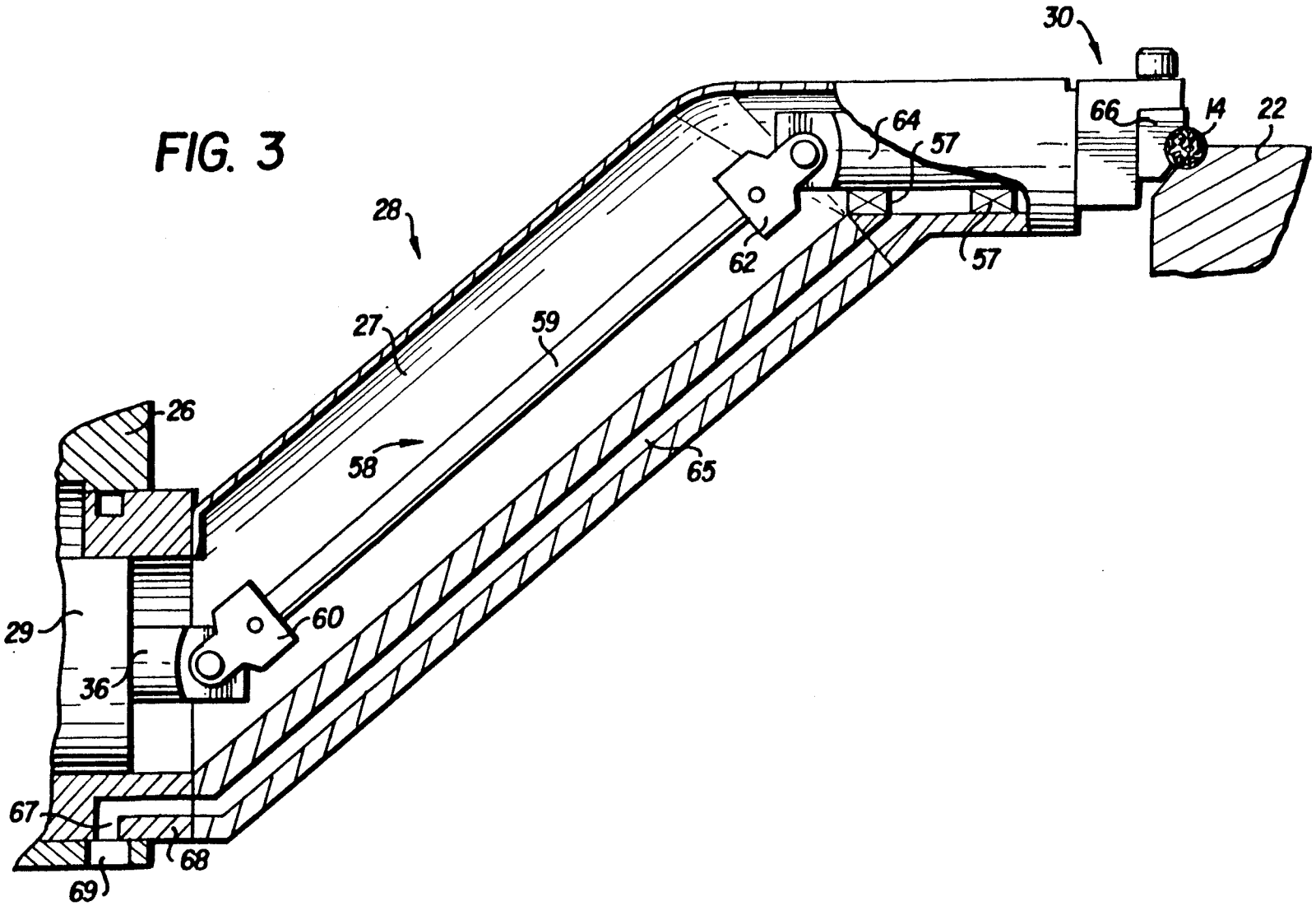
FIG. 3 is a partial cross-sectional view of a holder and crank arm combination in the transfer position.

FIG. 3 illustrates a crank arm 28 and holder 30 located at the cigarette transfer position adjacent the guide 22 for the serial file of cigarettes. The crank arm 28 includes a crank arm housing 27 attached to the end of the crank arm shaft 29 for rotation with shaft 29. Article holder shaft 36 is drivingly connected to the holder 30 for rotating the latter by means of a suitable drive mechanism. For purposes of illustration only, this mechanism is shown herein as a Cardanic joint 58 although other mechanisms may be used. Joint 58 comprises a connecting rod 59 and a pair of pivoting universal joints 60, 62 connected between holder shaft 36 and a holder stub shaft 64 rotatably mounted in crank arm housing 27 by anti-friction bearings 57. Holder 30 is connected to stub shaft 64 so as to be rotatable therewith.

An alternative and preferred arrangement (not shown) to the Cardanic joint 58 for transferring the rotation of holder shaft 36 to stub shaft 64 employs a pair of bevel gears for each of the universal joints 60, 62. A connecting rod is rotatably mounted in bearings supported in the crank arm housing 27 and is connected to one bevel gear of each pair of bevel gears. The other bevel gear of each bevel gear pair is connected to a respective one of the holder shaft 36 and stub shaft 64. This arrangement is conventional and therefore need not be further described or illustrated herein.

A vacuum passage 65 is formed in crank arm housing 27 and communicates at one end through stub shaft 64 with a slot-shaped opening (not shown) in a cigarette pick-up device 66 forming part of holder 30. The other end of vacuum passage 65 communicates with an annular groove 67 in crank arm base 68 which communicates in turn via a passage 69 in housing 26 with a reduced pressure plenum (not shown) surrounding housing 26.

As the pick-up device 66 travels past the cigarette 14 in the transfer position on the guide 22, the suction from the slot-shaped opening in the device 66 extracts the cigarette 14 from the guide 22 and retains it on the holder 30 until it is transferred to the drum conveyor 32 at the leftmost position of the crank arm and holder as viewed in FIG. 1. At that position for transfer of the cigarette 14 from the holder 30 to the drum conveyor 32, suction is preferably interrupted to the pick-up device 66. Suction may be interrupted by closing off an arcuate portion of the annular groove 67 so as to block the passage 69 in the housing 26 when the crank arm 28 is in the proper angular position relative to the housing 26.

Figure 4:
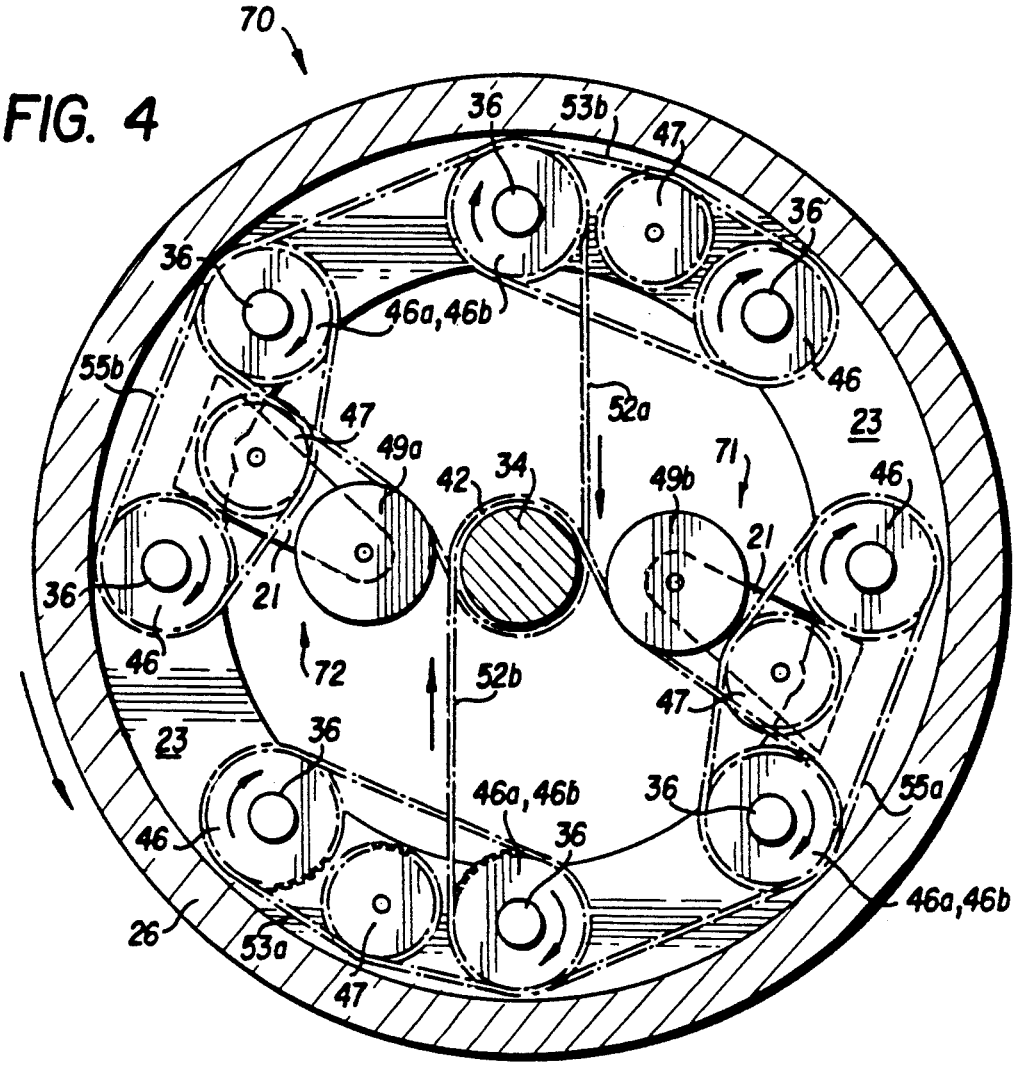
FIG. 4 is a cross-sectional view of a belt and pulley drive arrangement for an article holder drive mechanism with eight article holders taken along line 4—4 of FIG. 2.
Figure 5:
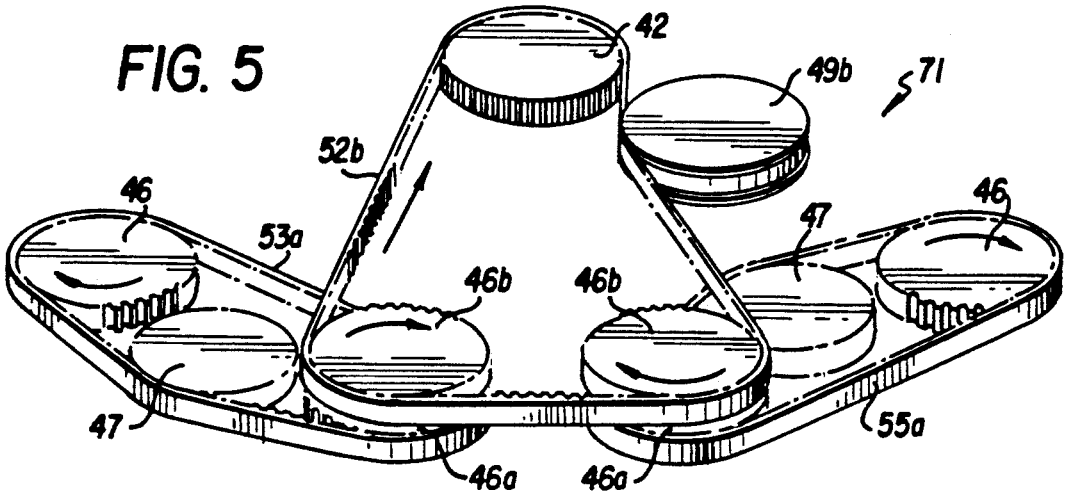
FIG. 5 is a schematic perspective view of the belt and pulley drive arrangement of FIG. 4 for one set of four article holders.

Referring to FIG. 4, there is illustrated an article holder drive mechanism for eight article holders which is designated generally by reference numeral 70. One half of the drive mechanism 70 is illustrated in schematic perspective view in FIG. 5. Four article holder shafts 36 are provided with a single toothed article holder shaft pulley 46 and four shafts 36 are provided with a pair of coaxial toothed holder shaft pulleys 46*a*, 46*b*. The article holder shafts 36 are driven in two groups of four by two pulley and belt arrangements 71, 72, one set 71 of which is shown in FIG. 5. Each set 71, 72 comprises a pair of coaxial toothed holder shaft pulleys 46*a*, 46*b*, a pair of single holder shaft pulleys 46 and three toothed belts 52*b* (or 52*a*), 53*a* (or 53*b*) and 55*a* (or 55*b*). Belt 52*b* (or 52*a*) is trained about article holder drive pulley 42 on the main shaft 34 and one pulley 46*b* of the pair of coaxial holder shaft pulleys 46*a*, 46*b*. Belts 53*a* (or 53*b*) and 55*a* (or 55*b*) are each trained about one of the other pulleys 46*a* (or 46*b*) of one coaxial pair of pulleys 46*a*, 46*b* and one of the single holder shaft pulleys 46.

With the above-described belt and pulley arrangement, rotation of the housing 26 in the counterclockwise direction as viewed in FIG. 4 about main shaft 34 will cause the belts 52*a* and 52*b* to move relatively in the directions shown by the arrows which will in turn cause all the article holder shaft pulleys 46, 46*a* and 46*b* and the shafts 36 connected thereto to rotate clockwise relative to the housing 26 as shown by the arrows on the shaft pulleys. Since the diameters of shaft pulleys 46, 46*a* and 46*b* and drive pulley 42 are the same, one rotation of the housing 26 will result in one rotation of the article holder shafts 36 thereby maintaining the article holders 30 parallel to the axis of serial file S.

Belt tensioner pulleys 49*a*, 49*b* for tensioning belts 52*a* and 52*b*, respectively, are rotatably supported on bracket arms 21 mounted to an annular flange 23 extending radially inwardly from the inner circumferential wall of housing 26. Belt tensioner pulleys 47 for tensioning belts 53*a*, 53*b*, 55*a* and 55*b* are rotatably supported on flange 23 or the bracket arms 21. The axes of belt tensioner pulleys 47, 49*a* and 49*b* are preferably arranged on eccentrics in a conventional. manner for adjusting the tension in the toothed belts.

Figure 6:
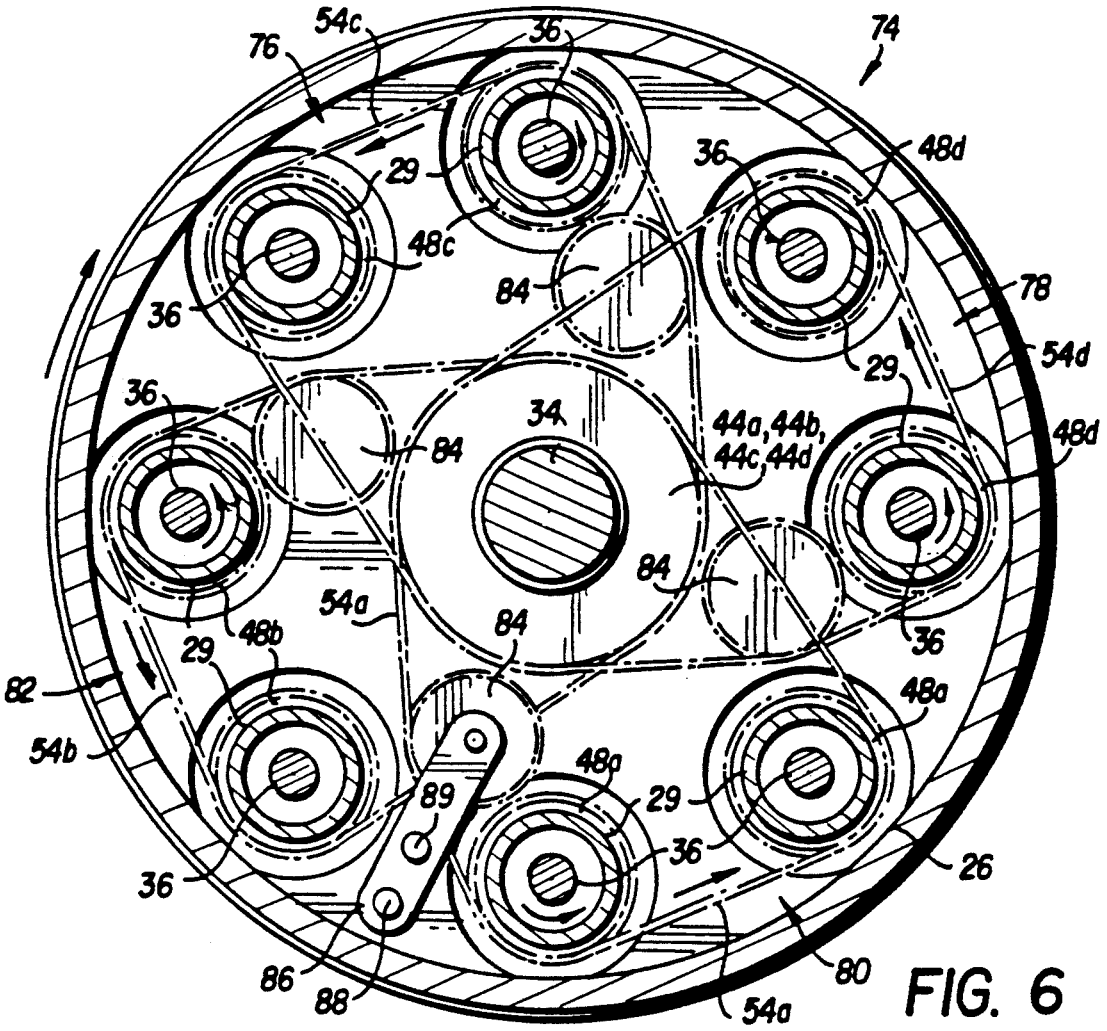
FIG. 6 is a cross-sectional view of a belt and pulley drive arrangement for a crank arm drive mechanism with eight crank arms taken along line 6—6 of FIG. 2.
Figure 7:
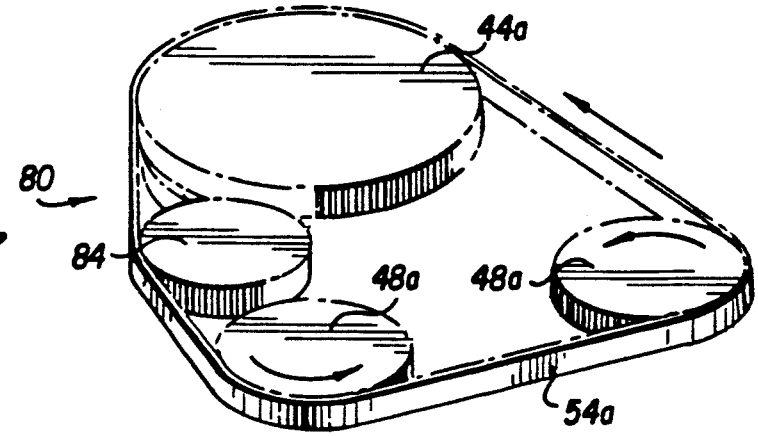
FIG. 7 is a schematic perspective view of the belt and pulley drive arrangement of FIG. 6 for a portion of the crank arms.

FIG. 6 illustrates the crank arm drive mechanism for eight crank arms which is designated generally by reference numeral 74. A one-quarter portion of the drive mechanism 74 is shown in schematic perspective view in FIG. 7. The crank arm drive mechanism 74 comprises four interrelated drive sets 76, 78, 80, 82, each drive set being configured for rotatably driving two adjacent crank arm shafts 29 and the associated toothed crank arm shaft pulleys 48*a*–48*d*. Each drive set includes a crank arm drive pulley 44*a*–44*d* fixed to main shaft 34, a pair of crank arm shaft pulleys 48*a*, 48*b*, 48*c* or 48*d* and a toothed belt 54*a*–54*d* trained about the drive pulley and the two shaft pulleys of each of the four drive sets.

As the housing 26 rotates clockwise as viewed in FIG. 6, the belts 54*a*–54*d* will move relatively in the directions shown by the arrows and will cause the crank arm shaft pulleys 48*a*–48*d* to rotate counterclockwise relative to the housing 26. The diameter of the drive pulleys 44*a*–44*d* is twice the diameter of the shaft pulleys 48*a*–48*d* so that for each revolution of the housing, the drive pulleys 44*a*–44*d* will remain stationary and the shaft pulleys 48*a*–48*d* will rotate two revolutions.

Toothed belt tensioner pulleys 84 are rotatably supported on pivot arms 86 (only one shown) pivotally mounted to flange 23 (FIG. 4) by means of a pivot pin 88. An eccentric mechanism 89 may be used to position the pivot arm 86 about the pivot pin 88 and thereby adjust the tension in a respective belt 54*a*–54*d*.

Figure 8:
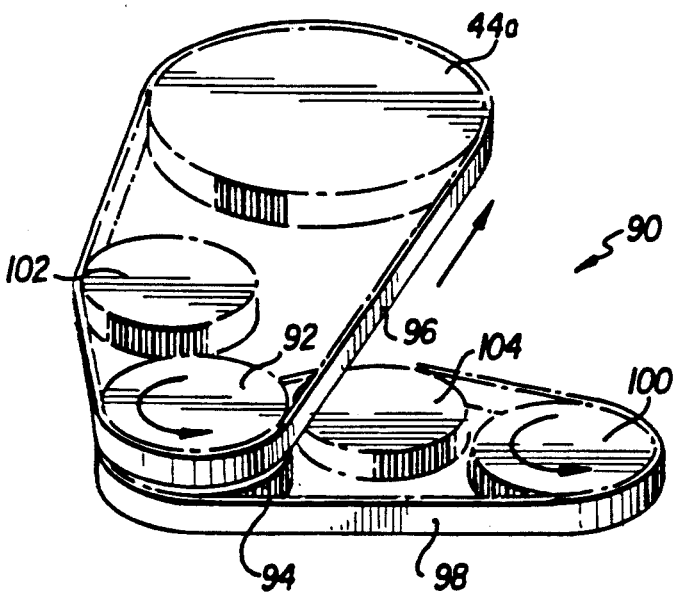
FIG. 8 is a schematic perspective view of an alternative belt and pulley drive arrangement for the crank arms.

FIG. 8 illustrates in schematic perspective view an alternate embodiment of the crank arm drive mechanism showing one drive set 90 for two crank arm shafts. In this embodiment, one of the crank arm shafts 29 is provided with a pair of axially-spaced, coaxial toothed crank arm shaft pulleys 92, 94. A first toothed belt 96 is trained about one of the crank arm drive pulleys 44*a* and one of the coaxial crank arm shaft pulleys 92. A second toothed belt 98 is trained about the other coaxial crank arm shaft pulley 94 and an adjacent crank arm shaft pulley 100. Belt tensioner pulleys 102, 104 are provided for maintaining tension on belts 96, 98.

The operation of the spider mechanism 24 of the invention is as follows. Housing 26 is rotated about main shaft 34 by a toothed timing belt 37 which engages toothed pulley 35 fixed to housing 26. The rotational speed of the housing is adjusted to the velocity of movement of the serial file S of rod-shaped articles or cigarettes. Rotation of housing 26 causes the toothed belts of the article holder drive mechanism 70 and the crank arm drive mechanism 74 to rotate the article holder shaft pulleys 46, 46*a* and 46*b* one revolution per housing revolution and to rotate the crank arm shaft pulleys 48*a*–48*d* two revolutions per housing revolution.

Such rotation of the article holder shaft pulleys 46, 46*a* and 46*b* results in rotation of each article holder 30 relative to the housing via shaft 36, joint 58 and stub shaft 64 so as to maintain the longitudinal axis of the pick-up device 66 parallel to the axis of serial file S. The above-described rotation of the crank arm shaft pulleys 48*a*–48*b* causes the outermost ends of the crank arms 28 which support the holders 30 to move in the same elongated elliptical or orbital path so that each holder 30 traverses past the transfer position of the cigarette guide 22 in the position shown in FIG. 3 to enable suction pick-up of a cigarette 14 located at that position. Similarly, each article holder 30 is constrained to pass through the position for releasing the cigarette carried thereby to the drum conveyor 32. The rotational speeds of the housing 26 and drum conveyor 32 are coordinated with the linear velocity of the rod-shaped articles or cigarettes 14 along the axis of serial file S so that (1) each holder 30 arrives at the cigarette transfer position at the same linear velocity as the moving serial file S and (2) each holder 30 carrying a cigarette arrives at the cigarette releasing position at the drum conveyor 32 at substantially zero linear velocity along the axis of serial file S.

The transfer apparatus of the invention may be used with either individual cigarette rods or with double length cigarette rods or with other rod-shaped articles. The length of pick-up device 66 and the speed of rotation of the spider mechanism 24 are determined by the length of individual cigarette rod elements and the speed of production. Although eight crank arms and holders are shown and described herein, other combinations are contemplated with suitable adjustments made in the relative sizes of the housing, holders, crank arms, pulley diameter ratios, etc.

The embodiments described herein have been applied mainly to reorienting files of rod-shaped articles, such as cigarettes. However, it is contemplated that other articles having longitudinal axes, such as food, confectionery articles, or the like, can also be reoriented using the apparatus of the present invention.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that this invention be limited only to the extent required by the appended claims and the applicable rules of law.

What is claimed is:

1. Apparatus for transferring cigarettes from a serial file of cigarettes to parallel rows of cigarettes comprising:

a main shaft;

a housing rotatably mounted on said shaft;

means for rotating said housing about said shaft;

a plurality of crank arms each having first and second ends, each crank arm being rotatably mounted at said first end to said housing, said crank arm being rotatable relative to said housing such that upon rotation of said housing and said crank arms the second ends of said crank arms define a path of travel;

first belt means connected between said shaft and said crank arms for rotating said crank arms relative to said housing;

a plurality of holder means for picking up the cigarettes in the serial file and for transferring the cigarettes to parallel rows of cigarettes, each holder means being rotatably mounted to said second end of a respective crank arm; and second belt means connected between said holder means and said shaft for rotating said holder means relative to said housing.

2. Apparatus according to claim 1, wherein said first and second belt means comprise a plurality of toothed endless belts.

3. Apparatus according to claim 1, wherein each crank arm includes a crank arm shaft, and a toothed crank arm shaft pulley on each crank arm shaft, a toothed crank arm drive pulley on said main shaft, said first belt means including a toothed endless belt trained about said crank arm drive pulley and at least one of said crank arm shaft pulleys.

4. Apparatus according to claim 3, wherein said belt is trained about said crank arm drive pulley and at least two of said crank arm shaft pulleys.

5. Apparatus according to claim 3, including two crank arm shaft pulleys on the crank arm shaft of at least one crank arm and a second toothed endless belt trained about one of said two crank arm shaft pulleys of said one crank arm and the crank arm shaft pulley of another of said crank arms.

6. Apparatus according to claim 3, wherein the diameter of said crank arm drive pulley is twice the diameter of said crank arm shaft pulley.

7. Apparatus according to claim 3, said first belt means including a plurality of toothed endless belts, and a plurality of toothed crank arm drive pulleys on said main shaft, each belt being trained about one of said crank arm drive pulleys and two of said crank arm shaft pulleys.

8. Apparatus according to claim 7, including eight of said crank arms, four of said crank arm drive pulleys and four toothed endless belts.

9. Apparatus according to claim 1, wherein said holder means comprises a plurality of holder shafts and a toothed holder shaft pulley on each of said holder shafts, a toothed holder drive pulley on said main shaft, said second belt means including a first toothed endless belt trained about said holder drive pulley and at least two of said holder shaft pulleys.

10. Apparatus according to claim 9, including first and second holder shaft pulleys on at least two adjacent holder shafts, said first toothed endless belt being trained about said holder drive pulley and the first holder shaft pulley on each of said two adjacent holder shafts, said second belt means further including a second toothed endless belt trained about the second holder shaft pulley on one of said two adjacent holder shafts and a third holder shaft pulley and a third toothed endless belt trained about the second holder shaft pulley on the other of said two adjacent holder shafts and a fourth holder shaft pulley.

11. Apparatus according to claim 10, including two sets of said first, second, third and fourth holder shaft pulleys and two sets of said first, second and third belts trained about each set of holder shaft pulleys and said holder drive pulley.

12. Apparatus according to claim 3, wherein said holder means comprises a plurality of holder shafts and a toothed holder shaft pulley on each of said holder shafts, a toothed holder drive pulley on said main shaft, said second belt means including a first toothed endless belt trained about said holder drive pulley and at least two of said holder shaft pulleys.

13. Apparatus according to claim 12, including first and second holder shaft pulleys on at least two adjacent holder shafts, said first toothed endless belt being trained about said holder drive pulley and the first holder shaft pulley on each of said two adjacent holder shafts, said second belt means further including a second toothed endless belt trained about the second holder shaft pulley on one of said two adjacent holder shafts and a third holder shaft pulley and a third toothed endless belt trained about the second holder shaft pulley on the other of said two adjacent holder shafts and a fourth holder shaft pulley.

14. Apparatus according to claim 13, including two sets of said first, second, third and fourth holder shaft pulleys and two sets of said first, second and third belts trained about each set of holder shaft pulleys and said holder drive pulley.

15. Apparatus according to claim 9, wherein each crank arm includes a crank arm shaft, and a toothed crank arm shaft pulley on each crank arm shaft, a toothed crank arm drive pulley on said main shaft, said first belt means including a toothed endless belt trained about said crank arm drive pulley and at least one of said crank arm shaft pulleys.

16. Apparatus according to claim 15, including said first belt means including a plurality of toothed endless belts, and a plurality of toothed crank arm drive pulleys on said main shaft, each belt being trained about one of said crank arm drive pulleys and two of said crank arm shaft pulleys.

17. Apparatus according to claim 1, including a plurality of belt tensioner pulleys engageable with said first and second belt means for adjusting the tension in said belt means.

18. A rotary transfer apparatus for transferring rod-shaped articles, such as cigarettes, coming from an article maker in an end-to-end file to a file of parallel rows, comprising:

a conveyor for conveying the rod-shaped articles from the maker;

a knife for cutting the rod-shaped articles into desired lengths;

a guide for conveying the rod-shaped articles in a serial end-to-end file;

a rotary spider mechanism comprising a housing and a plurality of belt-driven rotary article holders and belt-driven crank arms cooperatively arranged and driven such that said article holders and said crank arms are independently driven by separate belts such that longitudinal axes of ends of said holders remain essentially aligned with the serial end-to-end file and the file of parallel rows; and a rotary drum for receiving cigarettes from said rotary spider mechanism whereby the serial end-to-end file is converted to a file of parallel rows of said rod-shaped articles.

19. A rotary transfer apparatus for transfer of rod-shaped articles such as cigarettes from an end-to-end file having an axis to a file of parallel rows, comprising:

a main shaft;

a housing rotatably driven about said shaft;

a plurality of rotatable crank arms each mounted on a crank arm shaft and each rotatably mounted in said rotatable housing;

a plurality of rotatable holders each mounted on a holder shaft, each holder shaft being rotatably mounted in said rotatable housing, each said holder being cooperatively attached at an outer end of a respective crank arm and having a pick-up device with a longitudinal axis, each said holder being rotatable independently of said crank arm;

a crank arm drive mechanism comprising a plurality of crank arm pulleys mounted on said main shaft and on said crank arm shafts and a plurality of cooperating belts trained about said crank arm pulleys; and a holder drive mechanism comprising a plurality of holder pulleys mounted on said main shaft and on said holder shafts with a plurality of cooperating belts trained about said holder pulleys, said holders having means for holding and releasing the rod-shaped articles, said crank arms and said holders being rotated by said belts in response to rotation of said housing such that the longitudinal axes of said pick-up devices are maintained essentially parallel to the axis of the end-to-end file.

20. A transfer apparatus for rod-shaped articles comprising a main shaft, a housing rotatable about said shaft, a plurality of crank arms rotatably mounted to said housing by crank arm shafts, and first endless belt means cooperating between said main shaft and said crank arm shafts for rotating said crank arms relative to said housing in response to rotation of said housing about said main shaft and including a plurality of holders rotatably mounted to outer ends of said crank arms, said holders including holder shafts, and second endless belt means cooperating between said main shaft and said holder shafts for rotating said holders relative to said housing in response to rotation of said housing about said main shaft.

21. The transfer apparatus of claim 20, wherein said first and second endless belt means comprise toothed belts.

* * * * *

UNITED STATES PATENT AND TRADEMARK OFFICE

CERTIFICATE OF CORRECTION

PATENT NO. : 5,327,803

DATED : July 12, 1994

INVENTOR(S) : C. Fred DeMey, III

It is certified that error appears in the above-indentified patent and that said Letters Patent is hereby corrected as shown below:

Column 4, line 53, "substantially coplanar" should be deleted.
Column 4, line 53, --substantially coplanar-- should be inserted after "aligned".

Signed and Sealed this

Fourteenth Day of March, 1995

*Attest:*

*Attesting Officer*

Bruce Lehman

BRUCE LEHMAN

*Commissioner of Patents and Trademarks*